US011788812B1

(12) United States Patent
Harrison

(10) Patent No.: US 11,788,812 B1
(45) Date of Patent: Oct. 17, 2023

(54) FIREARM MOUNTING ASSEMBLY

(71) Applicant: Craig Harrison, Hampstead, NH (US)

(72) Inventor: Craig Harrison, Hampstead, NH (US)

( * ) Notice: Subject to any disclaimer, the term of this patent is extended or adjusted under 35 U.S.C. 154(b) by 0 days.

(21) Appl. No.: 17/840,144

(22) Filed: Jun. 14, 2022

(51) Int. Cl.
*F41A 23/18* (2006.01)

(52) U.S. Cl.
CPC ..... *F41A 23/18* (2013.01)

(58) Field of Classification Search
CPC ..... F41A 23/00; F41A 23/02; F41A 23/04; F41A 23/13; F41A 23/16; F41A 23/18
See application file for complete search history.

(56) References Cited

U.S. PATENT DOCUMENTS

| | | | | |
|---|---|---|---|---|
| 4,913,391 | A * | 4/1990 | Klipp | F41A 23/02 248/231.71 |
| 5,664,750 | A * | 9/1997 | Cohen | F16M 11/041 248/231.71 |
| 6,032,911 | A * | 3/2000 | Osborne | F41A 23/18 248/229.15 |
| 7,690,606 | B1 * | 4/2010 | Batdorf | F41A 29/00 248/346.06 |
| D638,087 | S | 5/2011 | Schull | |
| 8,931,201 | B2 | 1/2015 | Gianladis | |
| 9,417,025 | B1 * | 8/2016 | McDonald | F41A 23/02 |
| 10,203,176 | B1 * | 2/2019 | Peterson | F41A 17/44 |
| 10,415,922 | B2 * | 9/2019 | Reik | F41A 23/18 |
| 10,458,740 | B2 | 10/2019 | Hines | |
| 10,488,142 | B2 | 11/2019 | Jacobson | |
| 2009/0026679 | A1 * | 1/2009 | Harman, III | F41C 27/00 269/74 |
| 2011/0308131 | A1 * | 12/2011 | McLinda | F41A 23/06 42/94 |
| 2012/0227305 | A1 * | 9/2012 | Fontenot | F41A 23/02 42/94 |
| 2014/0182184 | A1 * | 7/2014 | Gianladis | F41A 23/18 42/94 |
| 2016/0363407 | A1 * | 12/2016 | Hanington | F41A 23/04 |
| 2019/0072356 | A1 | 3/2019 | Couie | |
| 2019/0086178 | A1 * | 3/2019 | Hines | F41A 23/18 |
| 2019/0162499 | A1 * | 5/2019 | Jacobson | F41A 23/18 |
| 2020/0408479 | A1 * | 12/2020 | Attanasio, Jr. | F41A 23/04 |
| 2022/0268544 | A1 * | 8/2022 | Palovaara | F41A 17/44 |

FOREIGN PATENT DOCUMENTS

| | | |
|---|---|---|
| WO | WO2012021804 | 2/2012 |

* cited by examiner

*Primary Examiner* — Joshua E Freeman

(57) ABSTRACT

A firearm mounting assembly includes a clamp that is attachable to a support panel. A screw threadably engages the clamp and the screw is rotatable in a tightening direction for securing the clamp to the support panel. Conversely, the screw is rotatable in a loosening direction for releasing the clamp from the support panel. A mount is rotatably disposed on the first bracket and the mount has a channel that is integrated into the mount. A block is pivotally positioned in the channel in the mount and the block is structured to conform to a magazine receiver of an AR-15 firearm. In this way the block facilitates the AR-15 to be mounted to the support panel for servicing the AR-15.

9 Claims, 7 Drawing Sheets

FIREARM MOUNTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mounting devices and more particularly pertains to a new mounting device for mounting an AR-15 on a support panel for servicing the AR-15. The device includes a clamp for mounting to a support panel and a mount that is rotatably disposed on the clamp. A block is pivotally coupled to the mount and the block is structured to conform to a magazine receiver of an AR-15 firearm. In this way the AR-15 can be mounted to the block thereby supporting the AR-15 in a preferred orientation for servicing the AR-15.

(2) Description of Related Art Including Information Disclosed Under 37 CFR 1.97 and 1.98

The prior art relates to mounting devices including a rifle mount which includes a clamp, a stanchion extending upwardly from the clamp and a sleeve disposed on the clamp for slidably receiving a rifle. The prior art discloses a firearm mount that includes a plate, a mount attached to the plate and a ball pivotally disposed in the mount. The prior art discloses a gun support that includes a plate, a block pivotally disposed on the mount for sliding into a magazine receiver of a firearm and a muzzle support extending upwardly from plate for supporting a muzzle of the firearm. The prior art discloses an armorer's stand that includes a block which can engage a magazine receiver in a firearm and a tongue on the block which can engage a base. The prior art discloses an ornamental design for a firearm stand which is mountable to hitch receiver of a vehicle.

BRIEF SUMMARY OF THE INVENTION

An embodiment of the disclosure meets the needs presented above by generally comprising a clamp that is attachable to a support panel. A screw threadably engages the clamp and the screw is rotatable in a tightening direction for securing the clamp to the support panel. Conversely, the screw is rotatable in a loosening direction for releasing the clamp from the support panel. A mount is rotatably disposed on the first bracket and the mount has a channel that is integrated into the mount. A block is pivotally positioned in the channel in the mount and the block is structured to conform to a magazine receiver of an AR-15 firearm. In this way the block facilitates the AR-15 to be mounted to the support panel for servicing the AR-15.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
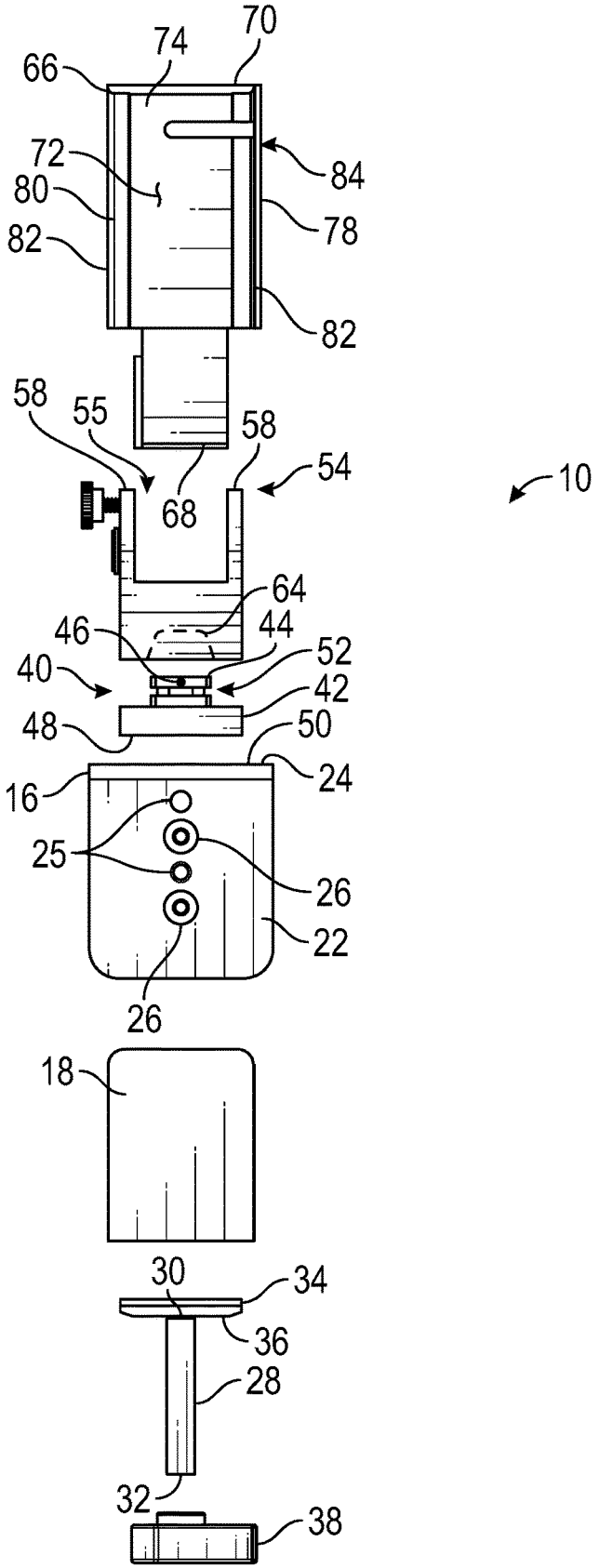
FIG. 1 is an exploded perspective view of a firearm mounting assembly according to an embodiment of the disclosure.
Figure 2:
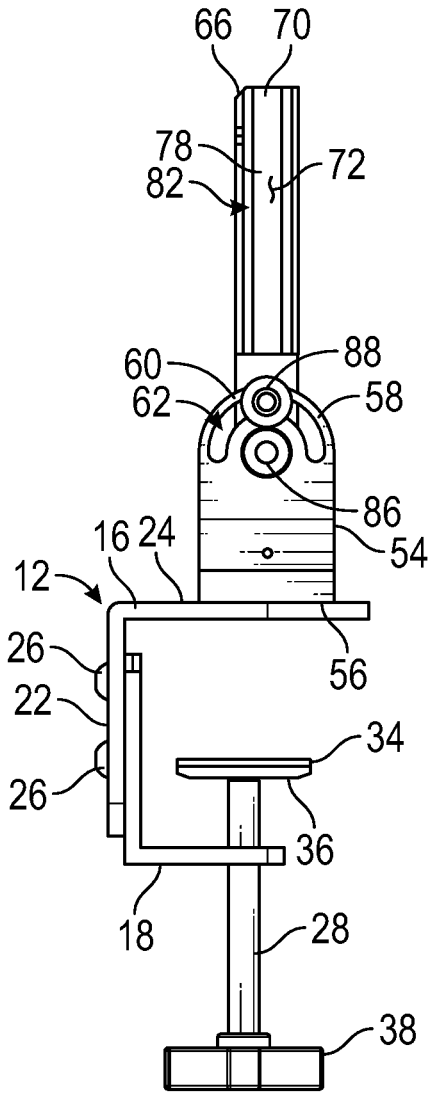
FIG. 2 is a left side view of an embodiment of the disclosure.
Figure 3:
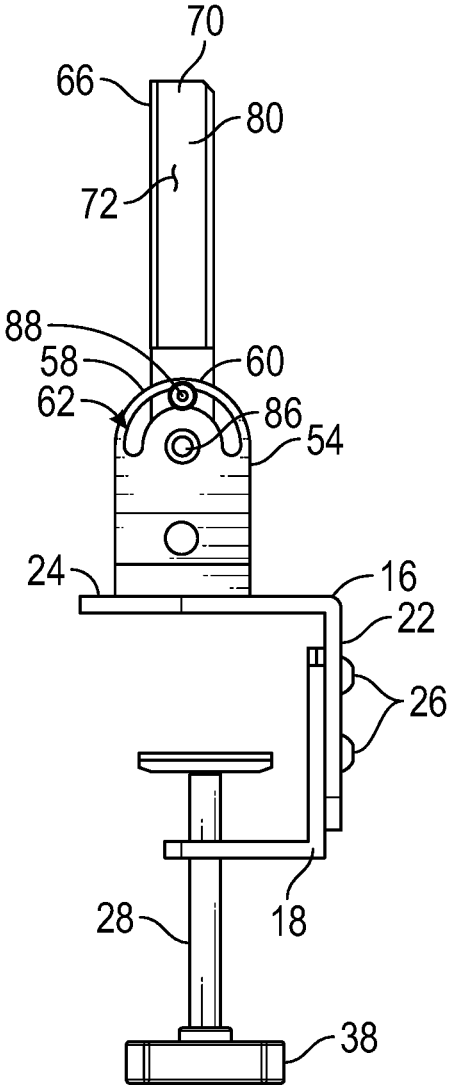
FIG. 3 is a right side view of an embodiment of the disclosure.
Figure 4:
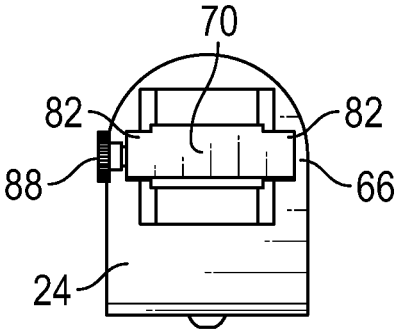
FIG. 4 is a top view of an embodiment of the disclosure.
Figure 5:
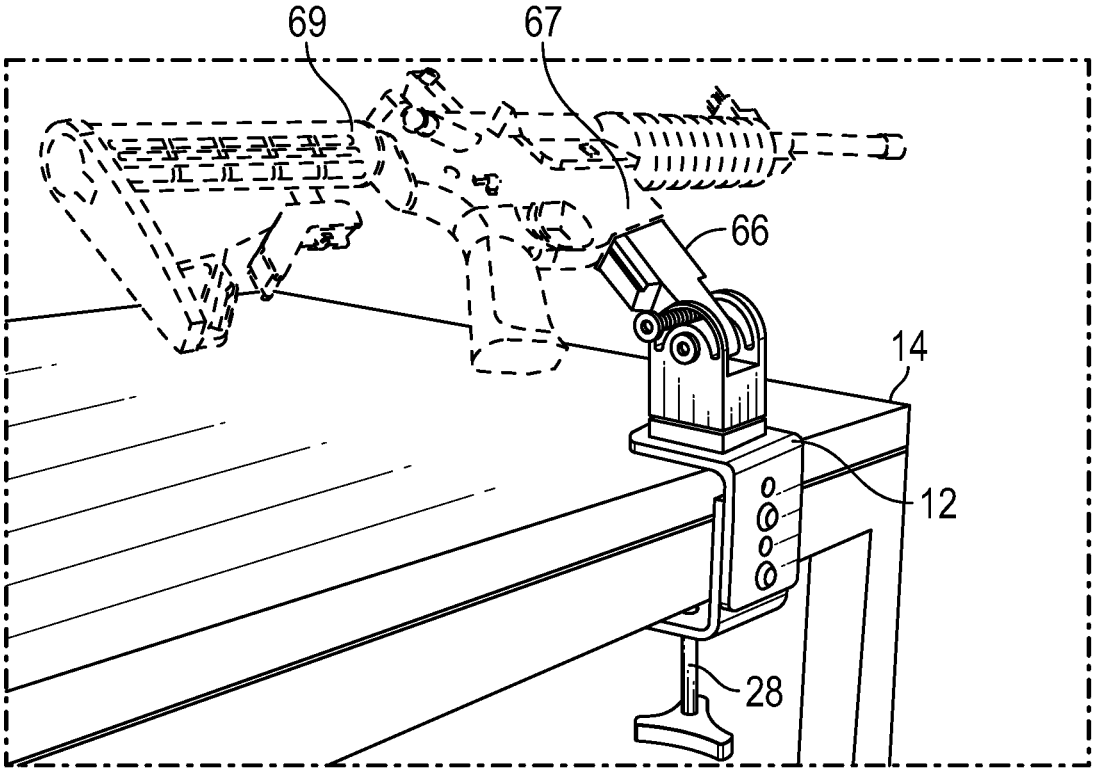
FIG. 5 is a perspective in-use view of an embodiment of the disclosure.
Figure 6:
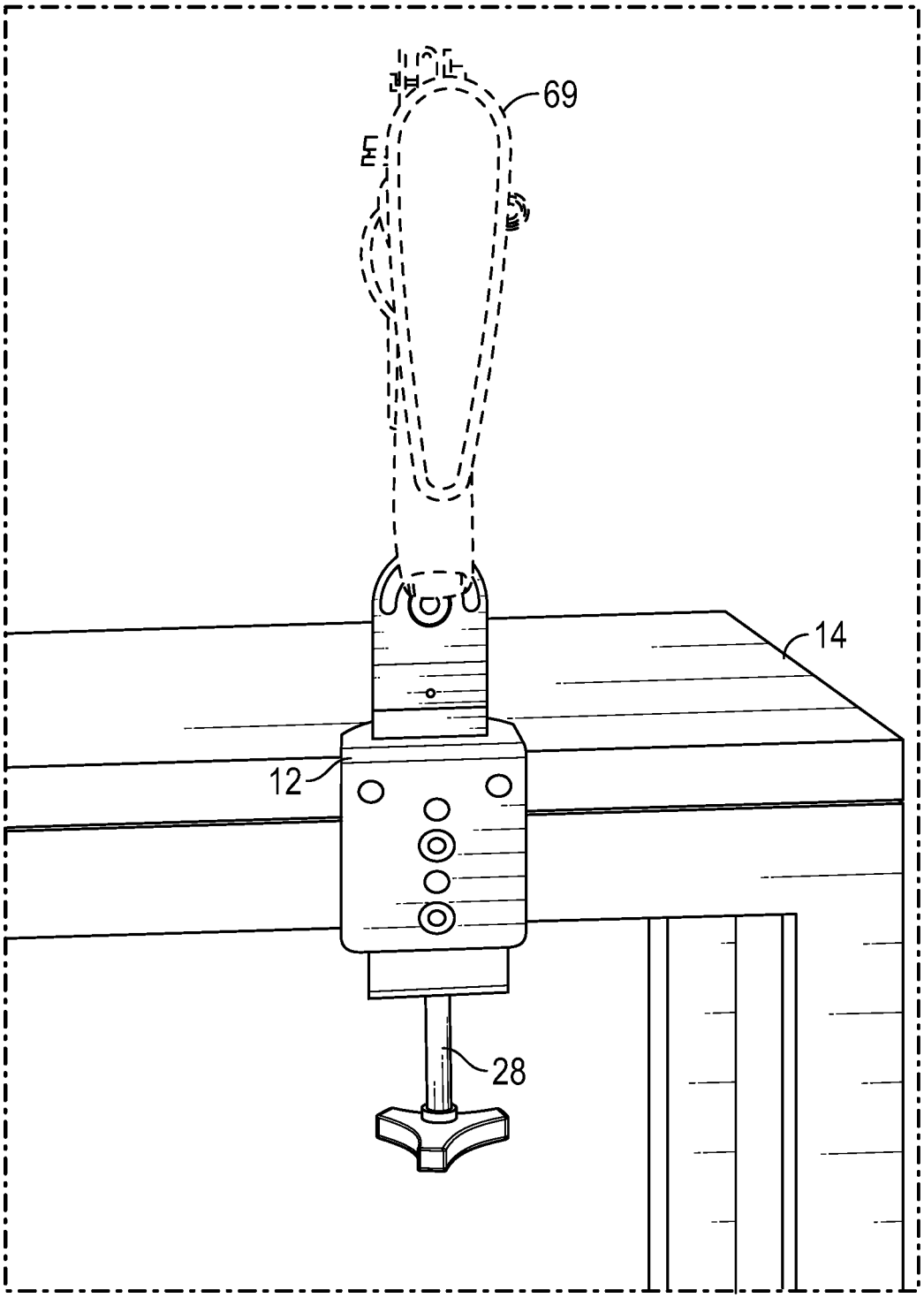
FIG. 6 is a rear in-use view of an embodiment of the disclosure.
Figure 7:
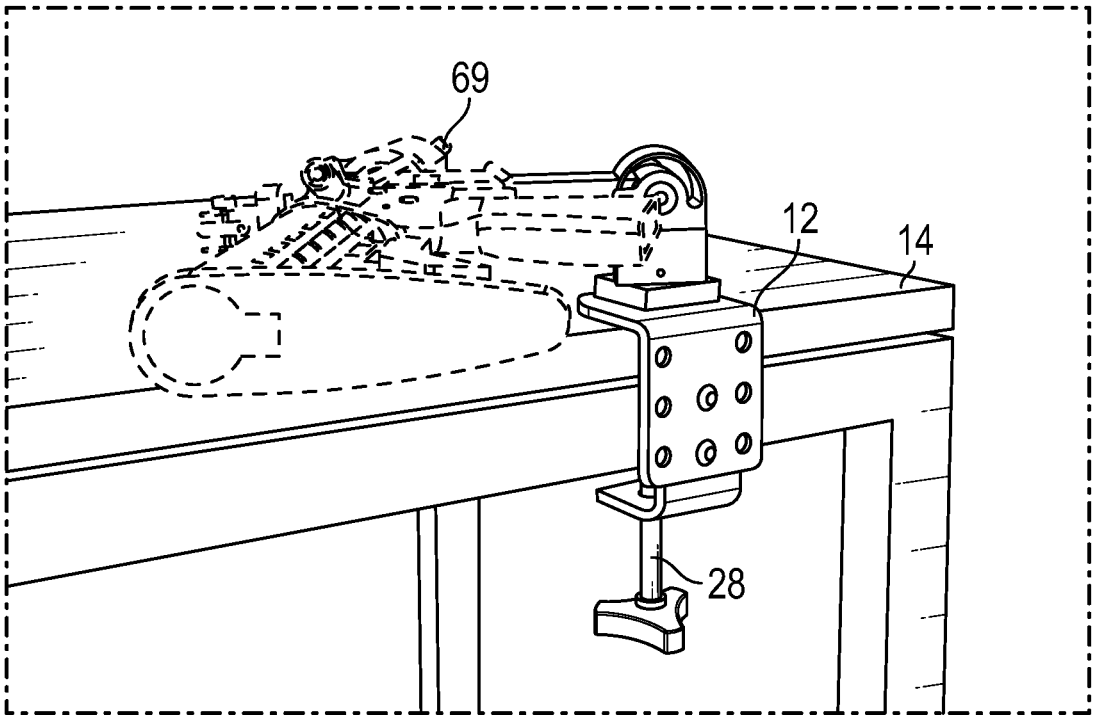
FIG. 7 is a perspective in-use view of an embodiment of the disclosure.

With reference now to the drawings, and in particular to FIGS. 1 through 7 thereof, a new mounting device embodying the principles and concepts of an embodiment of the disclosure and generally designated by the reference numeral 10 will be described.

As best illustrated in FIGS. 1 through 7, the firearm mounting assembly 10 generally comprises a clamp 12 that is attachable to a support panel 14 and the clamp 12 comprises a first bracket 16 and a second bracket 18. The support panel 14 may comprise a table top, a work bench or other similar type of horizontal surface upon which a firearm might be placed for servicing the firearm. Each of the first bracket 16 and the second bracket 18 has a first portion 22 forming an angle with a second portion 24. The first bracket 16 has a plurality of holes 25 each extending through the first portion 22 of the first bracket 16 and the holes 25 are spaced apart from each other and are vertically distributed on the first portion 22 of the first bracket 16. The first portion 22 of the first bracket 16 lies against the first portion 22 of the second bracket 18 such that the second portion 24 of the first bracket 16 is spaced from the second portion 24 of the second bracket 18.

A pair of fasteners 26 is provided and each of the fasteners 26 is extendable through a respective one of the holes 25 in the first portion 22 of the first bracket 16. Each of the fasteners 26 engages the first portion 22 of the second bracket 18 thereby facilitating the second portion 24 of the first bracket 16 to be spaced an adjustable distance from the second portion 24 of the second bracket 18. In this way the clamp 12 can accommodate a variety of support panels with respect to thickness. Each of the fasteners 26 may comprise a screw or other type of releasable, mechanical fastener. A screw 28 is provided which threadably engages the clamp 12 and the screw 28 is rotatable in a tightening direction for securing the clamp 12 to the support panel 14. Conversely, the screw 28 is rotatable in a loosening direction for releasing the clamp 12 from the support panel 14.

The screw 28 has an upper end 30 and a lower end 32, and the screw 28 extends through the second portion 24 of the second bracket 18. The screw 28 has a plate 34 which has a lower surface 36 that is disposed on the upper end 30 of the screw 28 such that the plate 34 is positioned between the second portion 24 of the first bracket 16 and the second portion 24 of the second bracket 18. In this way the plate 34 compresses against the support panel 14 when the screw 28 is tightened. Additionally, the screw 28 has a knob 38 that is disposed on the lower end 32 thereby facilitating the knob 38 to be gripped for rotating the screw 28.

A rotation block 40 is provided which has a base portion 42 and a stem portion 44 extending upwardly from the base portion 42. The stem portion 44 has an outer surface 46 and the base portion 42 has a bottom surface 48 which is attached to a top surface 50 of the second portion 24 of the first bracket 16. Additionally, the stem portion 44 has a groove 52 extending around the outer surface 46 of the stem portion 44.

A mount 54 is rotatably disposed on the first bracket 16 and the mount 54 has a channel 55 that is integrated into the mount 54. The mount 54 has a bottom end 56 and a pair of arms 58 each extending upwardly from the mount 54. The arms 58 are spaced apart from each other to define the channel 55 between the arms 58 and each of the arms 58 has a distal end 60 with respect to the top side of the mount 54. The distal end 60 of each of the arms 58 is curved and each of the arms 58 has a slot 62 extending through the arms 58. The slot 62 is positioned adjacent to the distal end 60 and the slot 62 is curved to follow curvature of the distal end 60. The mount 54 has a well 64 extending upwardly into the bottom end 56 and the well 64 insertably receives the stem of the rotation block 40 thereby facilitating the mount 54 to be rotatable on the mount 54. Additionally, the mount 54 may include an engagement element which is positioned in the groove 52 in the stem portion 44 of the rotation block 40.

A block 66 is pivotally positioned in the channel 55 in the mount 54 and the block 66 is structured to conform to a magazine receiver 67 of an AR-15 69 firearm. The AR-15 In this way the block 66 can facilitate the AR-15 69 to be mounted to the support panel 14 for servicing the AR-15 69. The block 66 has a lower end 68, an upper end 70 and an outside surface 72 extending between the upper end 70 and the lower end 66 of the block 66, and the outside surface 72 has a front side 74, a back side 76, a first lateral side 78 and a second lateral side 80. Each of the first lateral side 78 and the second lateral side 80 has a prominence 82 extending from the upper end 30 of the block 66 toward the lower end 32 of the block 66 such that the upper end 30 of the block 66 has a width that is greater than a width of the lower end 32 of the block 66. Additionally, the prominence 82 on the first lateral side 78 has a groove 84 extending along a full length of the prominence 82 on the first lateral side 78. The groove 84 is aligned with an intersection between the prominence 82 on the first lateral side 78 and the front side 74.

A pivot screw 86 extends through each of the arms 58 of the mount 54 and extends the block 66 for pivotally retaining the block 66 in the channel in the mount 54. A set screw 88 extends through the slot 62 in a respective one of the arms 58 of the mount 54. The set screw 88 is tightenable to engage the block 66 for retaining the block 66 at a selected angle in the mount 54 thereby facilitating the AR-15 69 to be retained at a desired orientation. A mechanized lock might be integrated into the mount 54 which engages the block 66 at a variety of locations for retaining the block 66 at the selected angle in the mount 54. Furthermore, a spring loaded pin might be integrated into the mount 54, which is biased to engage the block 66, and which can be pulled outwardly in the mount 54 to facilitate the block 66 to freely move.

In use, the clamp 12 is secured to the support panel 14 and the screw 28 is tightened to secure the clamp 12 to the support panel 14. The AR-15 69 is positioned on the block 66 such that the block 66 extends into the magazine receiver 67 on the AR-15 69. Furthermore, the block 66 is pivoted on the mount 54 to position the AR-15 69 in a desired orientation and the set screw 88 is tightened to retain the AR-15 69 in the desired orientation. In this way the AR-15 69 is supported to facilitate the AR-15 69 to be serviced.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A firearm mounting assembly for engaging a magazine receiver of an AR-15, said assembly comprising:

a clamp being attachable to a support panel, wherein said clamp comprises a first bracket and a second bracket, each of said first bracket and said second bracket having a first portion forming an angle with a second portion, said first bracket having a plurality of holes each extending through said first portion of said first bracket, said holes being spaced apart from each other and being vertically distributed on said first portion of said first bracket, said first portion of said first bracket lying against said first portion of said second bracket such that said second portion of said first bracket is spaced from said second portion of said second bracket;

a screw threadably engaging said clamp, said screw being rotatable in a tightening direction for securing said clamp to the support panel, said screw being rotatable in a loosening direction for releasing said clamp from the support panel;

a mount being rotatably disposed on a first bracket, said mount having a channel being integrated into said mount; and a block being pivotally positioned in said channel in said mount, said block being structured to conform to a magazine receiver of an AR-15 firearm wherein said block is configured to facilitate the AR-15 to be mounted to the support panel for servicing the AR-15.

2. The assembly according to claim 1, further comprising a pair of fasteners, each of said fasteners being extendable through a respective one of said holes in said first portion of said first bracket, each of said fasteners engaging said first portion of said second bracket thereby facilitating said second portion of said first bracket to be spaced an adjustable distance from said second portion of said second bracket.

3. The assembly according to claim 1, wherein said screw has an upper end and a lower end, said screw extending through said second portion of said second bracket, said screw having a plate which has a lower surface being disposed on said upper end of said screw such that said plate is positioned between said second portion of said first bracket and said second portion of said second bracket such that said plate compresses against the support panel when said screw is tightened, said screw having a knob being disposed on said lower end thereby facilitating said knob to be gripped for rotating said screw.

4. The assembly according to claim 1, further comprising a rotation block having a base portion and a stem portion extending upwardly from said base portion, said stem portion having an outer surface, said base portion having a bottom surface being attached to a top surface of said second portion of said first bracket, said stem portion having a groove extending around said outer surface of said stem portion.

5. The assembly according to claim 4, wherein:

said mount has a bottom end and a pair of arms each extending upwardly from said mount, said arms being spaced apart from each other to define said channel between said arms, each of said arms having a distal end with respect to said top side of said mount, said distal end of each of said arms being curved;

each of said arms has a slot extending through said arms, said slot being positioned adjacent to said distal end, said slot being curved to follow curvature of said distal end; and said mount has a well extending upwardly into said bottom end, said well insertably receiving said stem of said rotation block thereby facilitating said mount to be rotatable on said mount.

6. The assembly according to claim 5, further comprising a pivot screw extending through each of said arms of said mount and extending through said block for pivotally retaining said block in said channel in said mount.

7. The assembly according to claim 5, further comprising a set screw extending through said slot in a respective one of said arms of said mount, said set screw being tightenable to engage said block for retaining said block at a selected angle in said mount thereby facilitating the AR-15 to be retained at a desired orientation.

8. A firearm mounting assembly for engaging a magazine receiver of an AR-15, said assembly comprising:

a clamp being attachable to a support panel, wherein said clamp comprises a first bracket and a second bracket;

a screw threadably engaging said clamp, said screw being rotatable in a tightening direction for securing said clamp to the support panel, said screw being rotatable in a loosening direction for releasing said clamp from the support panel;

a mount being rotatably disposed on a first bracket, said mount having a channel being integrated into said mount;

a block being pivotally positioned in said channel in said mount, said block being structured to conform to a magazine receiver of an AR-15 firearm wherein said block is configured to facilitate the AR-15 to be mounted to the support panel for servicing the AR-15; and wherein said block has a lower end, an upper end and an outside surface extending between said upper end and said lower end of said block, said outside surface having a front side, a back side, a first lateral side and a second lateral side, each of said first lateral side and said second lateral side having a prominence extending from said upper end of said block toward said lower end of said block such that said upper end of said block has a width being greater than a width of said lower end of said block, said prominence on said first lateral side having a groove extending along a full length of said prominence on said first lateral side, said groove being aligned with an intersection between said prominence on said first lateral side and said front side.

9. A firearm mounting assembly for engaging a magazine receiver of an AR-15, said assembly comprising:

a clamp being attachable to a support panel, said clamp comprising a first bracket and a second bracket, each of said first bracket and said second bracket having a first portion forming an angle with a second portion, said first bracket having a plurality of holes each extending through said first portion of said first bracket, said holes being spaced apart from each other and being vertically distributed on said first portion of said first bracket, said first portion of said first bracket lying against said first portion of said second bracket such that said second portion of said first bracket is spaced from said second portion of said second bracket;

a pair of fasteners, each of said fasteners being extendable through a respective one of said holes in said first portion of said first bracket, each of said fasteners engaging said first portion of said second bracket thereby facilitating said second portion of said first bracket to be spaced an adjustable distance from said second portion of said second bracket;

a screw threadably engaging said clamp, said screw being rotatable in a tightening direction for securing said clamp to the support panel, said screw being rotatable in a loosening direction for releasing said clamp from the support panel, said screw having an upper end and a lower end, said screw extending through said second portion of said second bracket, said screw having a plate which has a lower surface being disposed on said upper end of said screw such that said plate is positioned between said second portion of said first bracket and said second portion of said second bracket such that said plate compresses against the support panel when said screw is tightened, said screw having a knob being disposed on said lower end thereby facilitating said knob to be gripped for rotating said screw;

a rotation block having a base portion and a stem portion extending upwardly from said base portion, said stem portion having an outer surface, said base portion having a bottom surface being attached to a top surface of said second portion of said first bracket, said stem portion having a groove extending around said outer surface of said stem portion;

a mount being rotatably disposed on said first bracket, said mount having a channel being integrated into said mount, said mount having a bottom end and a pair of arms each extending upwardly from said mount, said arms being spaced apart from each other to define said channel between said arms, each of said arms having a distal end with respect to said top side of said mount, said distal end of each of said arms being curved, each of said arms having a slot extending through said arms, said slot being positioned adjacent to said distal end, said slot being curved to follow curvature of said distal end, said mount having a well extending upwardly into said bottom end, said well insertably receiving said stem of said rotation block thereby facilitating said mount to be rotatable on said mount;

a block being pivotally positioned in said channel in said mount, said block being structured to conform to a magazine receiver of an AR-15 firearm wherein said block is configured to facilitate the AR-15 to be mounted to the support panel for servicing the AR-15, said block having a lower end, an upper end and an outside surface extending between said upper end and said lower end of said block, said outside surface having a front side, a back side, a first lateral side and a second lateral side, each of said first lateral side and said second lateral side having a prominence extending from said upper end of said block toward said lower end of said block such that said upper end of said block has a width being greater than a width of said lower end of said block, said prominence on said first lateral side having a groove extending along a full length of said prominence on said first lateral side, said groove being aligned with an intersection between said prominence on said first lateral side and said front side;

a pivot screw extending through each of said arms of said mount and extending said block for pivotally retaining said block in said channel in said mount; and a set screw extending through said slot in a respective one of said arms of said mount, said set screw being tightenable to engage said block for retaining said block at a selected angle in said mount thereby facilitating the AR-15 to be retained at a desired orientation.

* * * * *